US005762488A

United States Patent [19]

Weiler et al.

[11] Patent Number: 5,762,488

[45] Date of Patent: Jun. 9, 1998

[54] LIGHTER ESPECIALLY A GAS LIGHTER WITH A TOP PART, AN IGNITION UNIT, A PREFERABLY REGULATABLE FUEL VALVE AND A FUEL CONTAINER HAVING A CLOSING CAP

[76] Inventors: Matthias Weiler, Hepnersplatz 10/III; Horst Fries, Puotystrasse 29, both of 90403 Nurnberg, Germany

[21] Appl. No.: 572,078

[22] Filed: Dec. 14, 1995

[30] Foreign Application Priority Data

Dec. 15, 1994 [DE] Germany ..... 4444665.9

[51] Int. Cl.[6] ..... F23D 14/28

[52] U.S. Cl. ..... 431/344; 431/142; 431/154

[58] Field of Search ..... 431/345, 344, 431/144, 154, 145, 253, 277, 142; 126/414, 407, 142, 404

[56] References Cited

U.S. PATENT DOCUMENTS

| | | | |
|---|---|---|---|
| 3,174,310 | 3/1965 | Genoud | 431/344 |
| 3,181,589 | 5/1965 | Phelps | 431/344 |
| 3,709,655 | 1/1973 | Beijering | 431/344 |
| 4,181,493 | 1/1980 | Piffath et al. | 431/344 |

FOREIGN PATENT DOCUMENTS

| | | |
|---|---|---|
| GM 19 26 480 | 9/1965 | Germany . |
| 27 15 961 | 10/1977 | Germany . |
| 31 51 528 A1 | 7/1983 | Germany . |

*Primary Examiner*—James C. Yeung

*Attorney, Agent, or Firm*—Merchant Gould Smith Edell Welter and Schmidt

[57] ABSTRACT

The invention relates to a lighter, especially a gas lighter, with a top part, an ignition unit, a preferably regulatable fuel valve and a fuel container having a closing cap. The fuel container is connected to the top part via a manually actuable coupling device (8). The closing cap (6) comprises a mechanically actuable valve arrangement (7) which is actuated when a coupling takes effect between the top part (2) and closing cap (6) or fuel container (3), with the result that a flow connection is made between the fuel container (3) and the top part (2) or ignition unit (9).

15 Claims, 5 Drawing Sheets

LIGHTER ESPECIALLY A GAS LIGHTER WITH A TOP PART, AN IGNITION UNIT, A PREFERABLY REGULATABLE FUEL VALVE AND A FUEL CONTAINER HAVING A CLOSING CAP

FIELD OF THE INVENTION

The invention relates to a lighter, especially a gas lighter of the type having a top part, an ignition unit, a regulatable fuel valve and a fuel container connected to the top part and having a closing cap.

BACKGROUND OF THE INVENTION

The prior art on the one hand discloses refillable gas lighters, and on the other hand there are also so-called disposable gas lighters which do not allow refilling. Precisely where these disposable gas lighters are concerned, therefore, the user is compelled to dispose of the entire lighter which contains, in addition to plastic components, also metal components. Furthermore, disposable gas lighters of this type are also used as publicity media, their publicity value being limited by the limited period of use.

SUMMARY OF THE INVENTION

The object of the present invention is to provide a novel lighter which offers an increased publicity effect, but which, in contrast, at the same time allows simplified disposal.

In the lighter of the relevant generic type, this object is achieved in that, to guarantee an exchangeability of the fuel container, the fuel container can be connected to the top part via a manually actuable coupling device, and the closing cap comprises a mechanically actuable valve arrangement which is actuated when a coupling takes effect between the top part and closing cap or fuel container, with the result that a flow connection is made between the fuel container and the top part or ignition unit.

The invention makes it possible, above all, for empty fuel containers to undergo special disposal, without the top part which is separate from it having an adverse influence on disposal. Consequently, the disposal of disposable lighters produced according to the invention is simplified considerably in comparison with conventional disposable lighters. Moreover, the invention affords the advantage that, with the top part being reusable, the fuel container can be exchanged in a simple way, thus providing the possibility of offering and/or selling lighter ranges with a single top part and with differently designed or labelled fuel containers. A diversified publicity medium is thereby provided in comparison with conventional disposable lighters.

Furthermore, the invention guarantees simple operability. The assembly of the top part and fuel container at the same time makes a flow connection. When the two parts are released from one another, this flow connection is effectively broken. The coupling device brings about, on the one hand, a connection between the top part and the fuel container or closing cap and, on the other hand, an opening of the valve arrangement.

The valve arrangement is preferably designed as an axially opening valve to be actuated via the top part. The valve is preferably a non-return valve.

An especially simple handling of the lighter is achieved by the use of a snap connection, especially a tongue-and-groove snap connection, as a coupling.

According to another aspect of the invention, the actuation of the valve arrangement is accomplished via an extension on the top part. In order to guarantee an especially simple release of the connection of the top part to the fuel container, an unlocking aid is expediently provided for the coupling.

The use of inclined planes as an unlocking aid either on the top part and/or on the fuel container or its closing cap provides an unlocking aid which is very simple to handle and in which the top part merely has to be rotated slightly relative to the fuel container, in order to achieve a release of the coupling. This design is especially advantageous in terms of handling for anyone.

A slotting of the closing cap, at least in the region of its topside, makes it easier to engage the snap connection, without the effectiveness and reliability of the lighter being impaired.

Furthermore, it has proved advantageous in terms of manufacture if the arrangement of the extension on the top part is arranged eccentrically in the region of the largest diameter of the top part. At the same time, the top part and/or the fuel container can be designed asymmetrically and have a narrowing shape in the region of the longer lateral extent.

Moreover, in terms of manufacture, it is advantageous if the closing cap is provided as a single modular part, that is to say already comprises the valve arrangement and is subsequently connected to the respective fuel container which, where appropriate, can be produced as continuous material.

In order to guarantee a sufficient protection of the fuel container that is provided as a replacement part, the latter is expediently equipped on its topside with a pull-off tab at least in the region of the valve arrangement.

It is advantageous if the size and cross-sectional shape of the top part and fuel container are coordinated with one another. This provides the possibility of shape-specific disposal, that is to say disposal of only those lighters of the respective shape.

BRIEF DESCRIPTION OF THE DRAWINGS

An expedient embodiment is explained in more detail below by means of the figures of these.

DESCRIPTION OF THE PREFERRED EMBODIMENT

Figure 1:
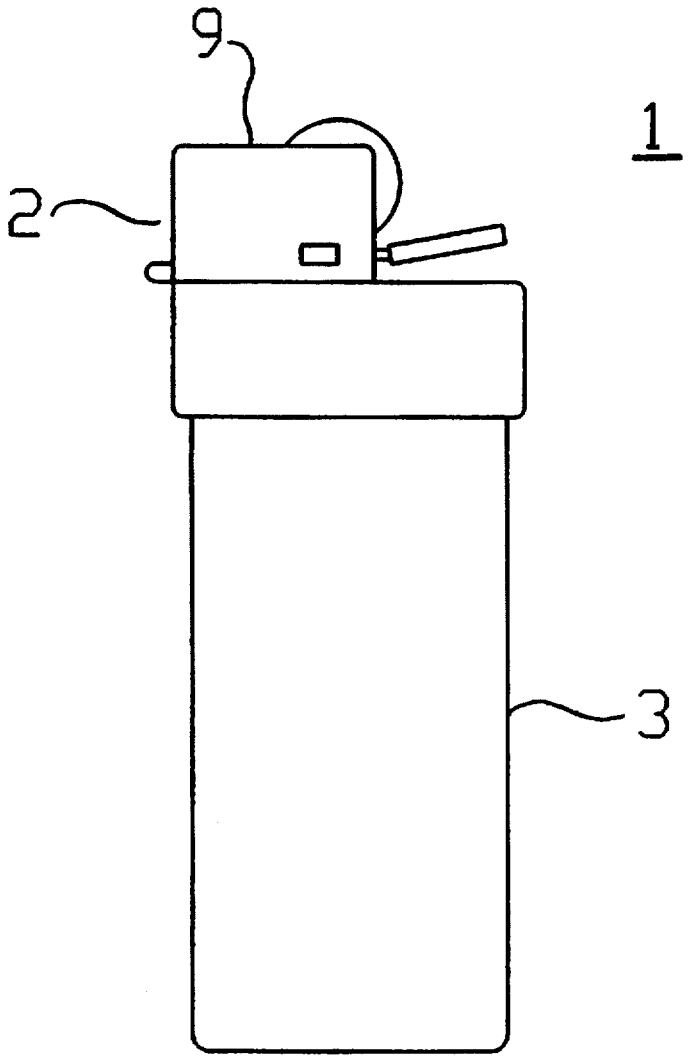
FIG. 1 shows a side view of the lighter according to the invention in a greatly simplified diagrammatic mode of representation.

Reference symbol 1 in FIG. 1 denotes the lighter according to the invention as a whole. It consists of a fuel container 3 and of a top part 2, the top part 2 comprising the ignition unit 9 consisting of a friction wheel, an actuating lever for the fuel valve, a fuel valve and a flame-adjusting lever.

According to the invention, the respective fuel container 3 is connected releasably to the top part 2. If required, an emptied fuel container 3 can be replaced by a new filled fuel container.

Figure 2:
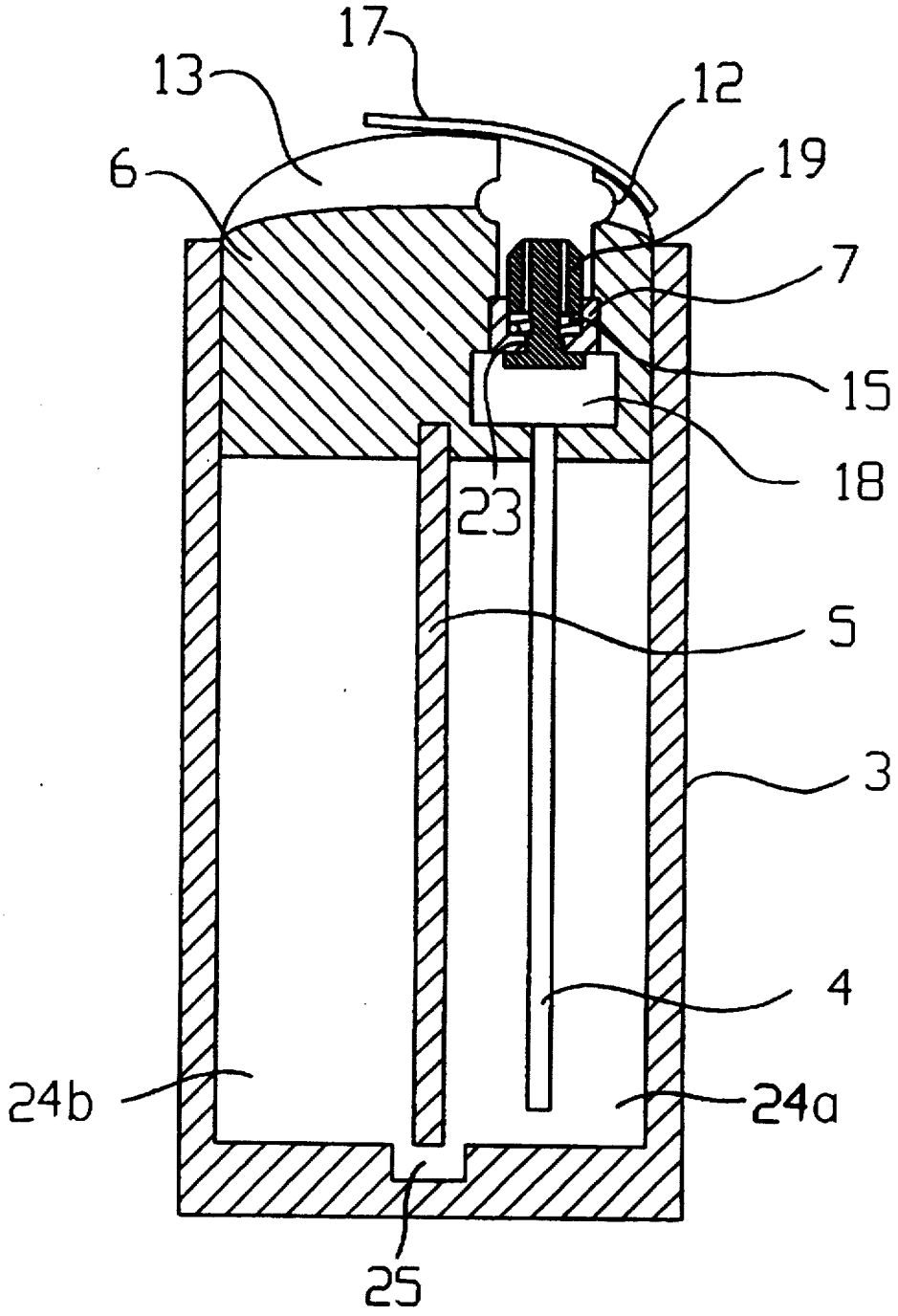
FIG. 2 shows a partly sectional representation of the fuel container, including the closing cap, for use in the lighter according to the invention.

For this purpose, the fuel container 3 according to FIG. 2 has a specially designed closing cap 6 which is inserted as a modular part on the topside of the fuel container 3. The closing cap 6 is, on the one hand, characterized by a valve arrangement 7 which is accommodated in an eccentrically provided bore and which, in the assembled state of the lighter 1, allows a flow path from the fuel container 3 into the top part 2.

The valve arrangement 7 is expediently an axially actuable non-return valve which, in the unactuated state according to FIG. 2, closes the passage 23, so that gas evaporating via the wick 4 in the chamber 18 cannot escape outwards. At the same time, the valve arrangement 7 is held in the closed position by means of a compression spring 15.

On the topside of the closing cap 6, a continuous recess 12 is located in the region of the bore, in order to form one component of a coupling 8 between the closing cap 6 or fuel container 3 and the top part 2.

The topside of the closing cap 6 is provided with an inclined plane 13 which, as will be explained in more detail later, serves as an aid for the manual unlocking of the coupling 8 between the top part 2 and fuel container 3. In FIG. 2, the inclined plane 13 runs into the plane of representation.

There is provided on the topside, for the protection of the valve arrangement 7, a pull-off tab 17 which can be removed by means of a simple manipulation immediately before the fuel container is connected to the top part 2. The fuel container 3 is separated in a known way into two fuel chambers 24*a*, 24*b* by means of an intermediate wall 5 having a passage 25 at the bottom, the wick 4 being located in one fuel chamber 24*a*.

The valve body 19 of the valve arrangement 7 comprises a plurality of longitudinal bores 20 which, in the opening position of the valve arrangement 7, guarantee a flow connection to the passage 22. The valve body 19 is bevelled circumferentially on its topside. In this region, the valve body 19 is engaged by an extension 10 on the top part 2.

Figure 3:
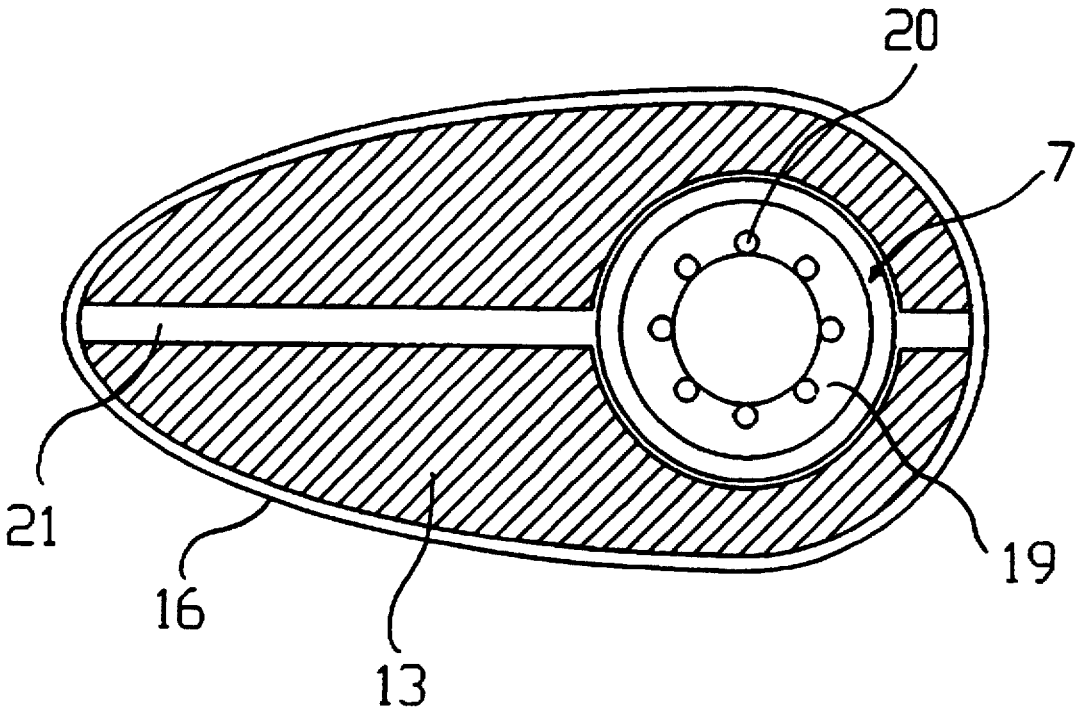
FIG. 3 shows a top view of the topside of the closing cap according to FIG. 2.

FIG. 3 shows a top view of the topside of the closing cap 6 according to FIG. 2. It becomes clear from FIG. 3 that the valve arrangement 7 is arranged eccentrically relative to the total width of the closing cap 6 in the region of the largest cross-section. However, one side of the closing cap 6 is provided longitudinally with a narrowing width (narrowing region 16). Located centrally is a continuous slot 21 for the purpose of making the snap connection simpler. For the sake of simplicity, FIG. 3 does not show the continuous recess 12 in the region of the bore for the valve arrangement 7. The regions identified in each case by hatching constitute the inclined plane 13. The valve body 19 possesses bores 20 circumferentially arranged in a circle, in order to guarantee a passage for the fuel when the lighter 1 is in the assembled state.

Figure 4:
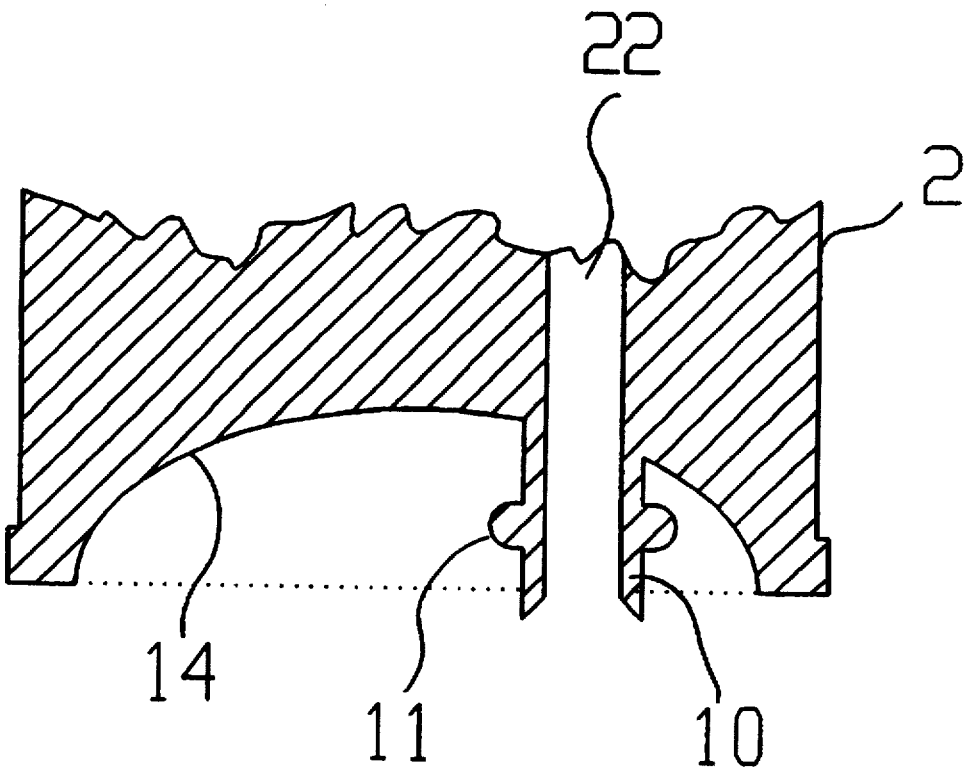
FIG. 4 shows a sectional representation of the region of the top part which ensures coupling between the top part and fuel container.

FIG. 4 shows that part of the top part 2 which serves for actuating the valve arrangement 7 and for guaranteeing the interlocking of the closing cap 6 and top part 2. The top part 2 possesses a recess 14 which is located on the underside and which has an eccentric extension 10 corresponding to the position of the valve arrangement 7 in the closing cap 6. The extension 10 contains a passage 22, running through the top part 2, upwards to the ignition unit 9 not shown. At the same time, the lower end of the extension 10 is bevelled inwards in a manner corresponding to the bevel of the topside of the valve body 19. The dotted line identifies that edge of the top part 2 which is continuous on the underside.

Figure 5:
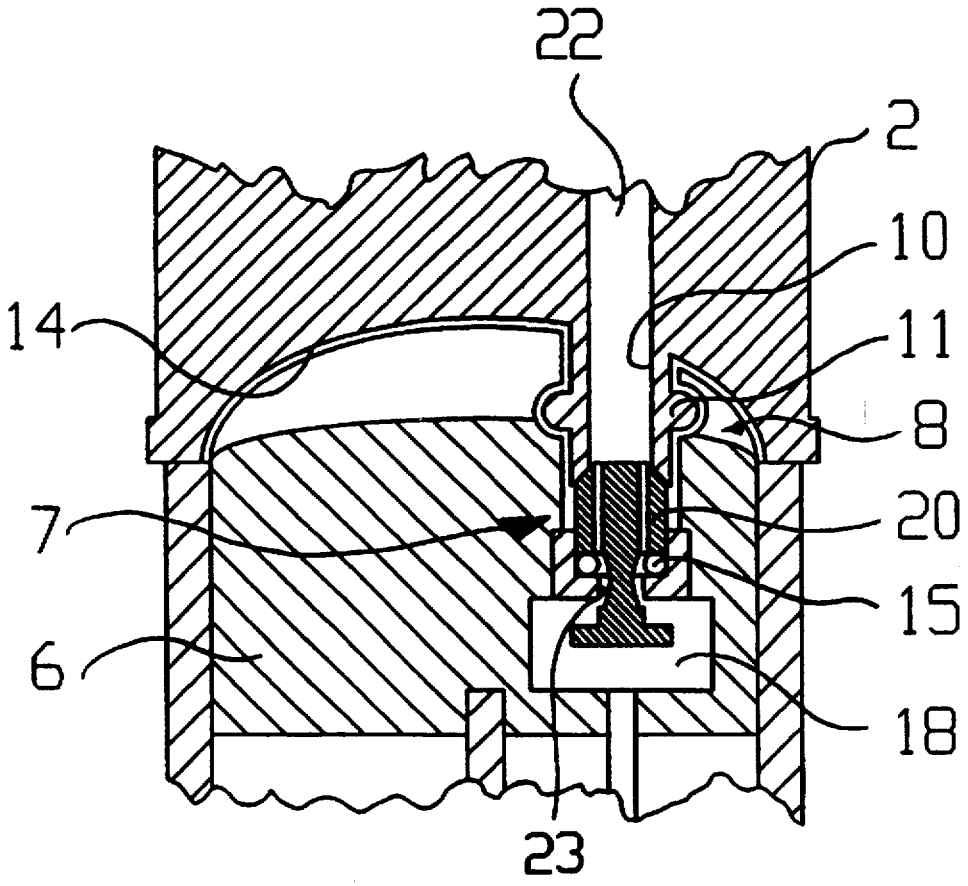
FIG. 5 shows a partly sectional representation of the connecting region between the closing cap of the fuel container and the top part, a flow connection existing between the fuel container and top part.

FIG. 5 shows in detail the cooperation of the coupling device 8 with the valve arrangement 7. In this case, the top part 2 is inserted via the extension 10 into the bore provided on the topside of the closing cap 6, the closing cap 6 being pressed outwards somewhat in the region of its topside as a result of the peripheral projection 11 on the extension 10, and the coupling device 8 subsequently snapping in as shown diagrammatically in FIG. 5. Simultaneously, via the front end of the extension 10, the valve body 19 of the valve arrangement 7 is pressed axially downwards, the compression spring 15 being compressed and a flow path from the chamber 18 into the passage 22 thereby being freed.

To release the coupling 8, the top part 2 is rotated slightly by hand relative to the fuel container 3 or to the associated closing cap 6, thereby guaranteeing a release of the coupling 8 as a result of the inclined plane 13. During the release of the coupling 8, the valve arrangement 7 automatically closes the chamber 18, so that no gaseous fuel can escape.

We claim:

1. A gas lighter having a top part, an ignition unit, a regulatable fuel valve and a fuel container having a closing cap; a manually actuatable coupling device for releasably connecting the fuel container to the top part; and the closing cap includes a mechanically actuatable valve arrangement which is actuated engagement of the coupling device (8) between the top part (2) and closing cap (6) or fuel to an open position when the fuel container is connected to the top part, thus providing a flow connection between the fuel container and the top part; and including a release mechanism for releasing the connection between the fuel container and the top part, the release mechanism being configured such that a rotational movement thereof releases the connection between the fuel container and the top part.

2. A gas lighter according to claim 1, wherein the valve arrangement is an axially opening valve and the top part includes an extension which engages with, and brings about an axial movement of, the valve arrangement when the fuel container is connected to the top part, thereby actuating the valve arrangement to the open position.

3. A gas lighter according to claim 2, wherein the manually actuatable coupling device comprises a tongue-and-groove snap connection provided between the top part and the closing cap of the fuel container.

4. A gas lighter according to claim 3, wherein the tongue-and-groove snap connection comprises at least one projection on the extension and a corresponding recess formed on the closing cap for receiving the at least one projection, and when the at least one projection is disposed within the recess, the valve arrangement is kept in the open position.

5. A gas lighter according to claim 2, wherein the valve arrangement and the extension are arranged eccentrically on the closing cap and the top part, respectively.

6. A gas lighter according to claim 5, wherein the closing cap has a shape narrowing towards an end thereof that is furthest from the valve arrangement.

7. A gas lighter according to claim 1, wherein the valve arrangement comprises a non-return valve.

8. A gas lighter according to claim 1, wherein the release mechanism comprises a first inclined plane formed on the top part and a second inclined plane formed on the closing cap.

9. A gas lighter according to claim 8, wherein the second inclined plane is arranged in a narrowing region of the closing cap.

10. A gas lighter according to claim 1, wherein the closing cap is slotted on a topside thereof.

11. A gas lighter according to claim 1, wherein the closing cap is a modular part that is secured to the fuel container.

12. A gas lighter according to claim 1, wherein the fuel container, before being connected to the top part, is equipped with a pull-off tab which at least covers the valve arrangement.

13. A gas lighter according to claim 1, wherein the size and the cross-sectional shape of the top part correspond to the size and the cross-sectional shape of the closing cap.

14. A gas lighter according to claim 1, wherein the ignition unit is an electronic ignition unit.

15. A gas lighter having a top part, an ignition unit, a regulatable fuel valve and a fuel container having a closing cap; a manually actuatable coupling device for releasably connecting the fuel container to the top part; and the closing cap includes a mechanically actuatable valve arrangement which is actuated to an open position when the fuel container is connected to the top part, thus providing a flow connection between the fuel container and the top part; and including a release mechanism for releasing the connection between the fuel container and the top part, the release mechanism including a first inclined plane formed on the top part and a second inclined plane formed on the closing cap, said inclined planes being disposed relative to each other such that upon a rotational movement of the planes relative to each other, an axial force is generated which releases the connection between the fuel container and the top part.

* * * * *

UNITED STATES PATENT AND TRADEMARK OFFICE
CERTIFICATE OF CORRECTION

PATENT NO. : 5,762,488

DATED : JUNE 9, 1998

INVENTOR(S) : WEILER ET AL.

It is certified that error appears in the above-identified patent and that said Letters Patent is hereby corrected as shown below:

Col. 1, line 20: delete "also" before the word "metal"

Col. 4, lines 22–23: delete "engagement of the coupling device (8) between the top part (2) and closing cap (6) or fuel" after the word "actuated"

Signed and Sealed this

Thirtieth Day of November, 1999

*Attest:*

*Attesting Officer*

Q. TODD DICKINSON

*Acting Commissioner of Patents and Trademarks*